US009803948B2

(12) United States Patent
Liao

(10) Patent No.: US 9,803,948 B2
(45) Date of Patent: Oct. 31, 2017

(54) TRIGGER EMULATION MECHANISM OF ELECTRIC GUN

(71) Applicant: Guay Guay Trading Co., Ltd., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 504 days.

(21) Appl. No.: 14/583,819

(22) Filed: Dec. 29, 2014

(65) Prior Publication Data

US 2016/0187095 A1 Jun. 30, 2016

(51) Int. Cl.

| | |
|---|---|
| ***F41A 33/00*** | (2006.01) |
| ***F41A 19/10*** | (2006.01) |
| ***F41A 19/14*** | (2006.01) |
| ***F41A 19/15*** | (2006.01) |
| ***F41A 19/59*** | (2006.01) |
| ***F41A 19/69*** | (2006.01) |
| ***F41A 33/02*** | (2006.01) |

(52) U.S. Cl.

CPC ..... *F41A 33/00* (2013.01); *F41A 19/10* (2013.01); *F41A 19/14* (2013.01); *F41A 19/15* (2013.01); *F41A 19/59* (2013.01); *F41A 19/69* (2013.01); *F41A 33/02* (2013.01)

(58) Field of Classification Search

CPC ..... F41A 33/00; F41A 33/04; F41A 33/06
USPC ..... 434/11, 16, 18
See application file for complete search history.

(56) References Cited

U.S. PATENT DOCUMENTS

| | | | | |
|---|---|---|---|---|
| 4,079,525 | A * | 3/1978 | Linton | F41A 33/06 434/18 |
| 7,581,954 | B2 * | 9/2009 | Schavone | F41B 11/51 124/74 |
| 8,585,407 | B2 * | 11/2013 | Hu | F41A 33/06 124/16 |
| 8,608,474 | B2 * | 12/2013 | Markert | F41A 33/06 434/11 |
| 9,200,864 | B2 * | 12/2015 | Lin | F41B 7/08 |
| 2014/0065577 | A1 * | 3/2014 | Quinlan | F41A 33/06 434/18 |
| 2014/0196267 | A1 * | 7/2014 | Tiberius | F41A 33/02 29/401.1 |
| 2014/0272806 | A1 * | 9/2014 | Hunt | F41A 33/00 434/16 |

(Continued)

*Primary Examiner* — Kurt Fernstrom
(74) *Attorney, Agent, or Firm* — Leong C. Lei

(57) ABSTRACT

A trigger emulation mechanism of an electric gun is disclosed. When actuated, a trigger assembly causes a retainer assembly to drive the toothed rack element to allow the toothed rack element to operate in combination with a gear shaft assembly to amplify a rotational angle, making the gear shaft assembly drive a striker hammer plate to rotate and allowing the striker hammer plate to drive the striker hammer elastic element to accumulate energy therein. Afterward, the retainer assembly may release the toothed rack element, causing the striker hammer elastic element to force the striker hammer plate to rotate in an opposite direction to strike thus generate sound and vibration, thereby achieving advantages of enhancing the degree of simulation by generating sound and vibration and an idle stroke before firing is initiated and also reducing the size thereof for applications to various models of electric guns.

9 Claims, 13 Drawing Sheets

(56) References Cited

U.S. PATENT DOCUMENTS

2015/0300766 A1* 10/2015 Sims ..... F41A 33/00
434/16

* cited by examiner

TRIGGER EMULATION MECHANISM OF ELECTRIC GUN

(a) TECHNICAL FIELD OF THE INVENTION

The present invention generally relates to a trigger emulation mechanism of an electric gun that achieves high-degree true simulation by generating sounds, vibration, and an idle stroke before firing through actuation and allows for size reduction for applications to various models of electric guns.

(b) DESCRIPTION OF THE PRIOR ART

True simulation is now a trend of the market of electric guns. A simple function of firing no longer satisfies the needs of the general consumers seeking for being as close to a true gun in all respects, including the outside appearance. A conventional electric gun that is available in the market has a structure that when an operator actuates a trigger, a motor is immediately activated to proceed with firing. This does not generate sounds or vibrations caused by a trigger-initiated firing operation of a true gun where a striker is driven after the trigger is pulled to proceed with firing, neither an idle stroke after the trigger is pulled but before the firing. This is not sufficient in simulation of a true device.

SUMMARY OF THE INVENTION

An object of the present invention is to simulate the sounds and vibrations generated by a true gun and to allow an operator to perceive an idle stroke between trigger pulling and firing and to achieve size reduction to widen the application thereof.

To achieve the above object, the present invention comprises a trigger seat. The trigger seat has one side in which a guide slot is formed. A trigger assembly is arranged at one side of the trigger seat. The trigger seat comprises a retainer assembly coupled to the trigger assembly. The retainer assembly comprises a guide roller formed at one side thereof and operable in combination with the guide slot. The trigger seat comprises a toothed rack element formed thereon and operable in combination with the retainer assembly. The trigger seat comprises a gear shaft assembly mounted thereto and operable in combination with the toothed rack element. The gear shaft assembly comprises at least one striker hammer plate mounted thereto. The striker hammer plate is coupled to a striker hammer elastic element that is mounted to the trigger seat.

When actuated, the trigger assembly drives the retainer assembly to move and the retainer assembly is moved according to the guide slot causes the toothed rack element to move. Through engagement between the toothed rack element and the gear shaft assembly, the striker hammer plate is caused to rotate and a rotational angle is amplified to thereby cause the striker hammer elastic element to accumulate energy so that before the trigger assembly is actuated to move a predetermined angle, an operator is allowed to perceive an idle stroke between the actuation and firing.

When the trigger assembly is actuated to reach a predetermined angle, the retainer assembly, being guided by the guide slot to move, releases the toothed rack element. And, the striker hammer elastic element release the accumulated energy to force the striker hammer plate to rotate in an opposite direction, allowing the striker hammer plate to strike thus generate sound and vibration. As such, the drawback of the conventional electric gun that the degree of simulation of a true device is not good can be overcome and the generation of sound and vibration and an idle stroke before firing is initiated by the actuation helps enhance the degree of simulation of a true device. Further, the size is reduced to allow for wide applications to various models of electric guns.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
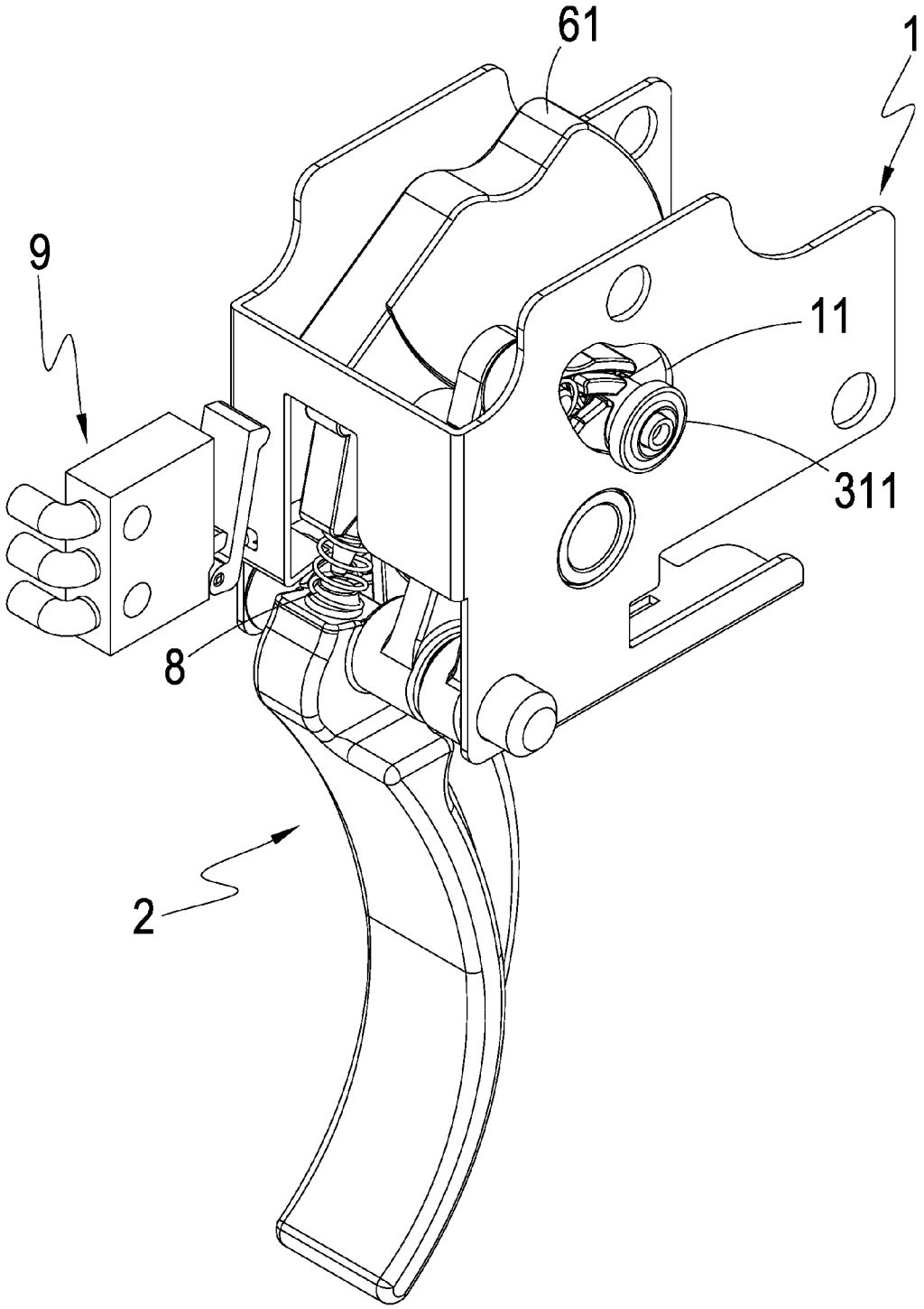
FIG. 1 is a perspective view of the present invention.
Figure 2:
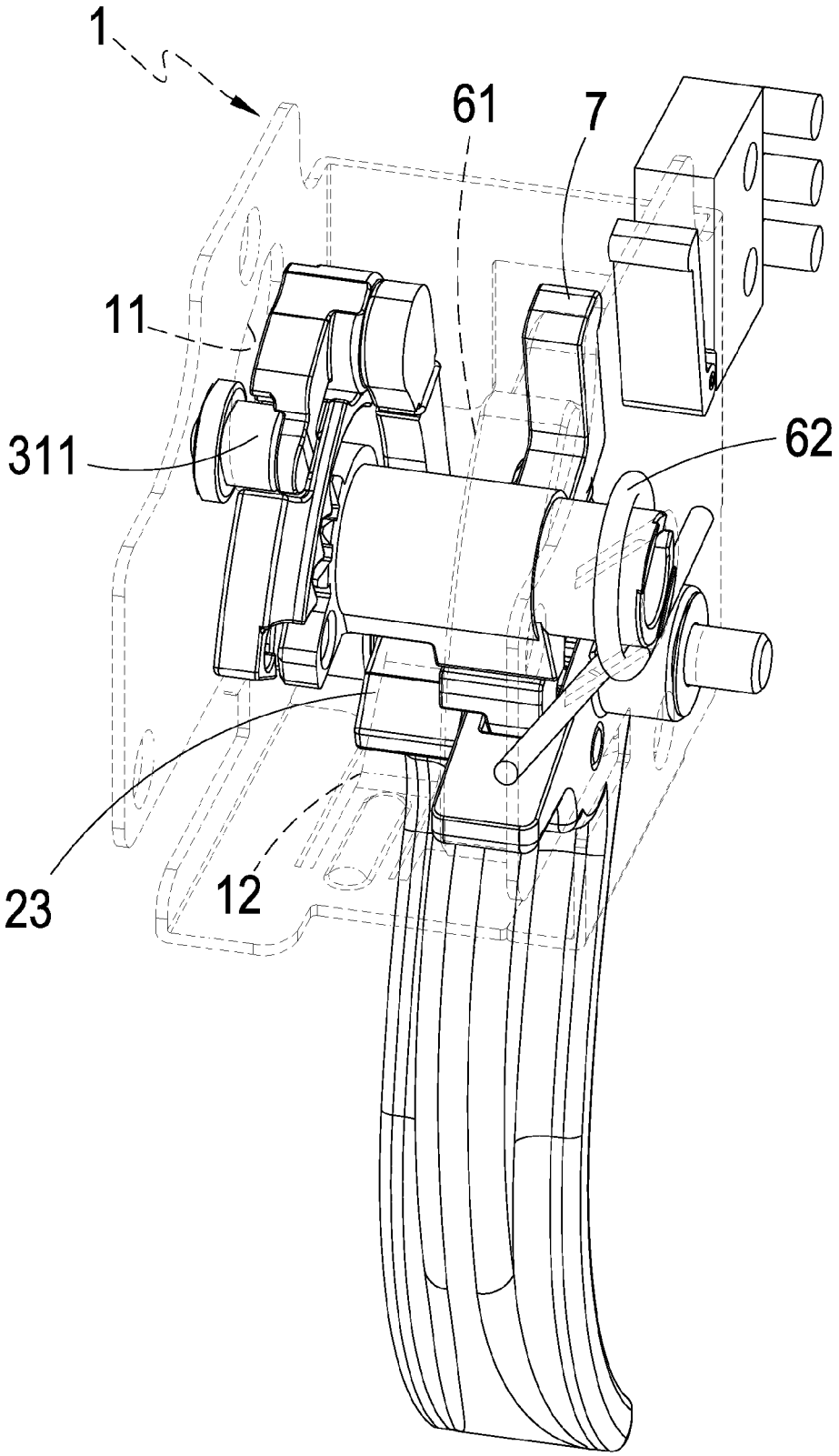
FIG. 2 is a perspective view showing a portion of the present invention.
Figure 3:
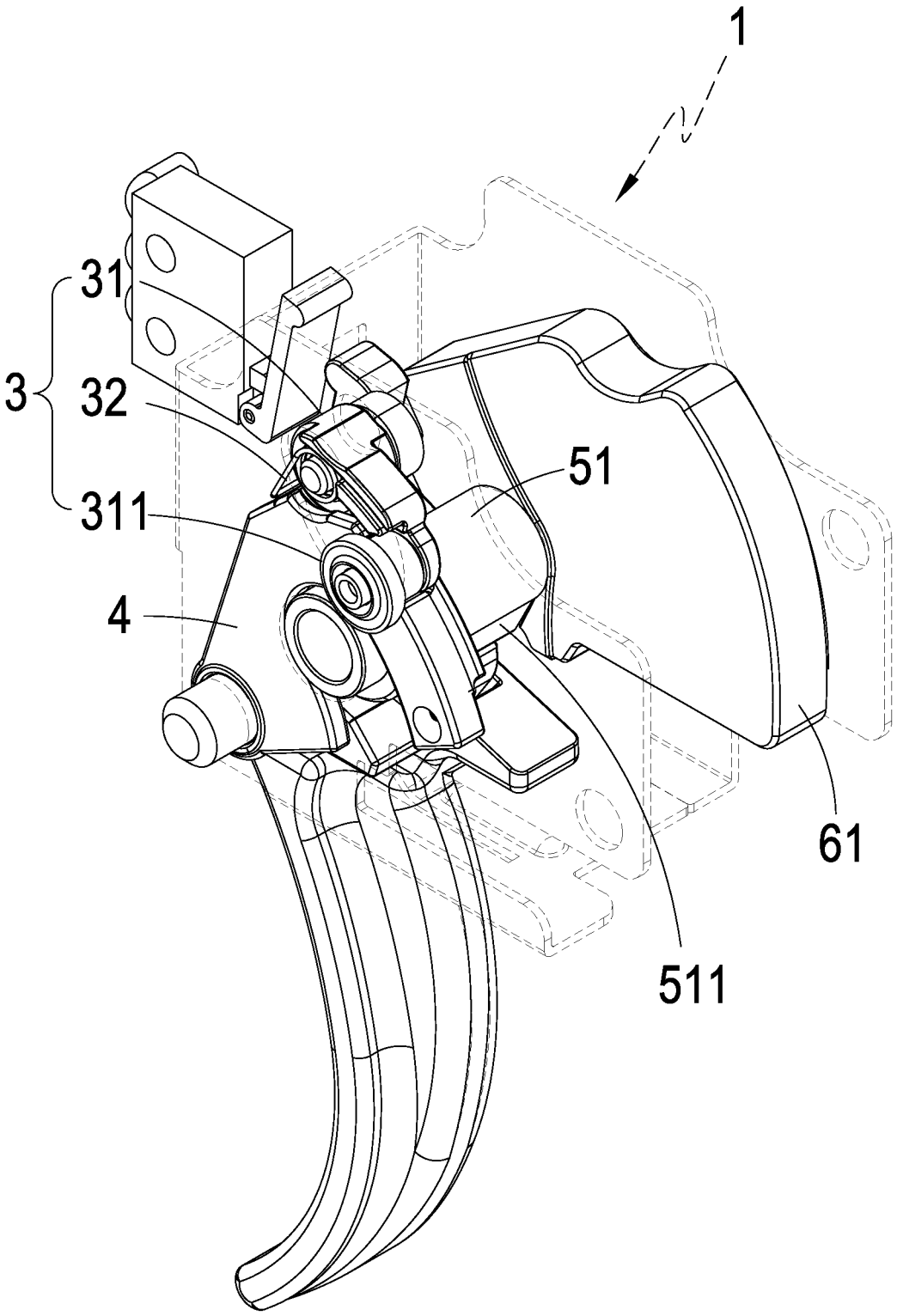
FIG. 3 is another perspective view showing a portion of the present invention.
Figure 4A:
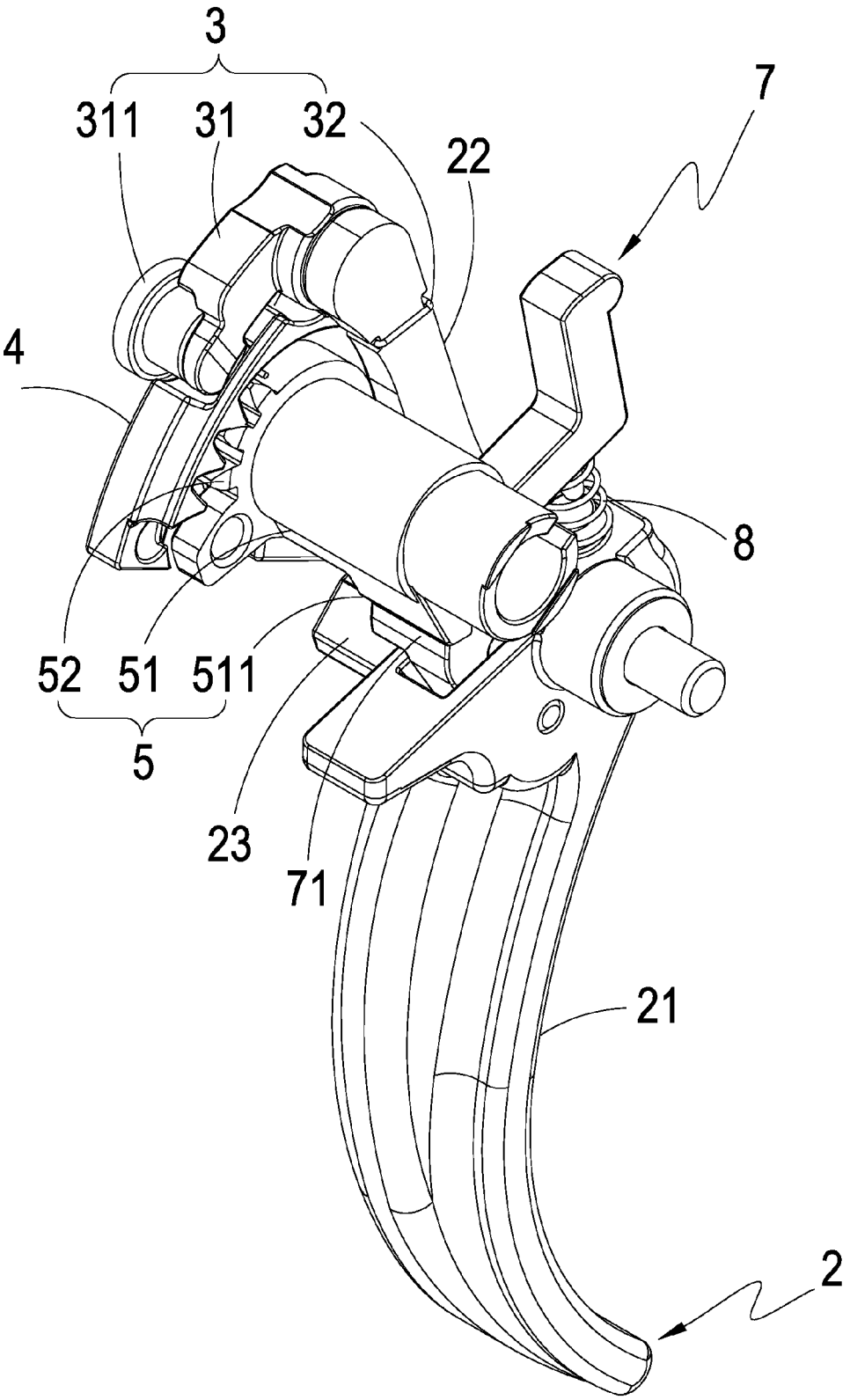
FIG. 4A is a perspective view of a portion of the present invention.
Figure 4B:
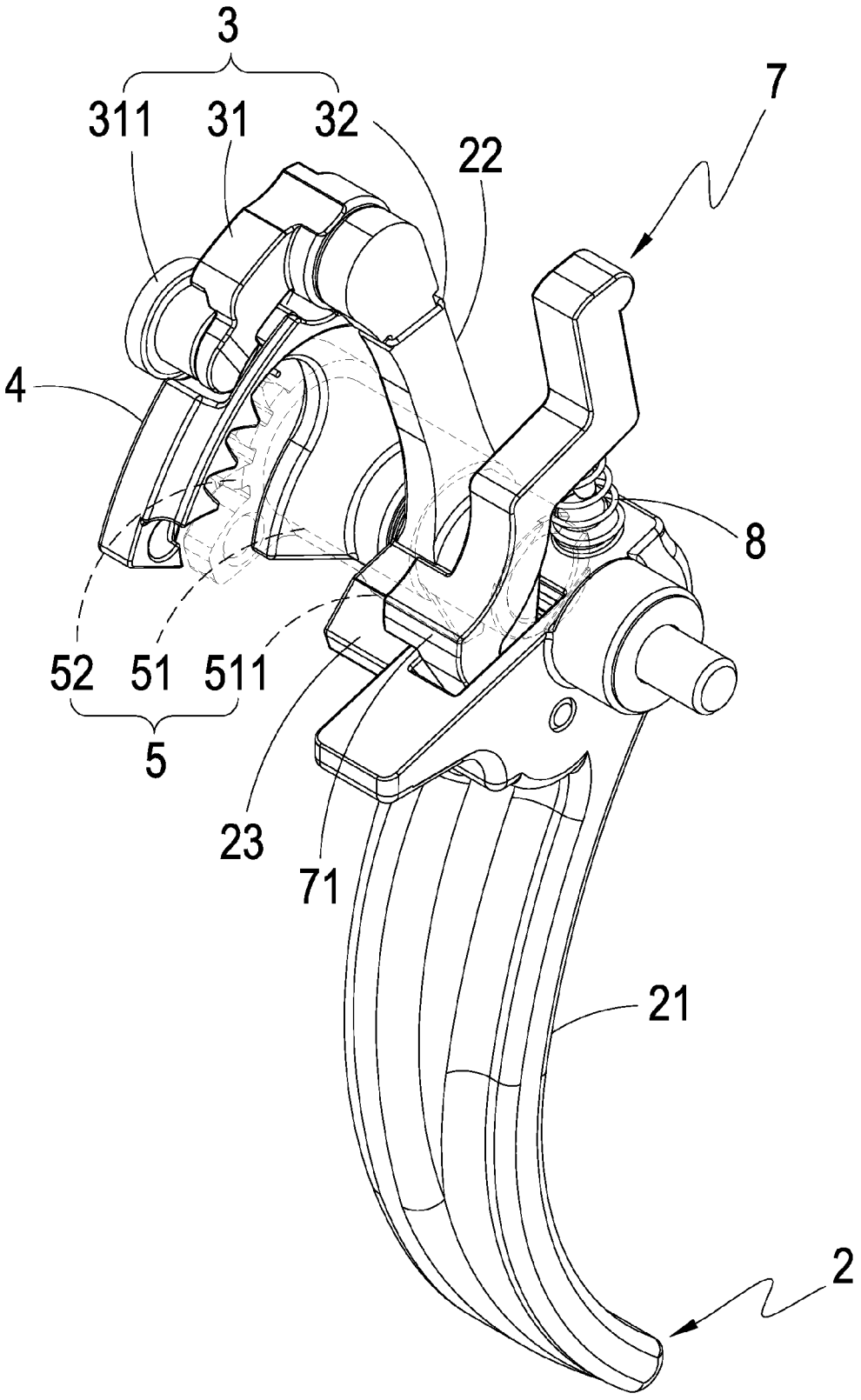
FIG. 4B is another perspective view of a portion of the present invention.
Figure 5:
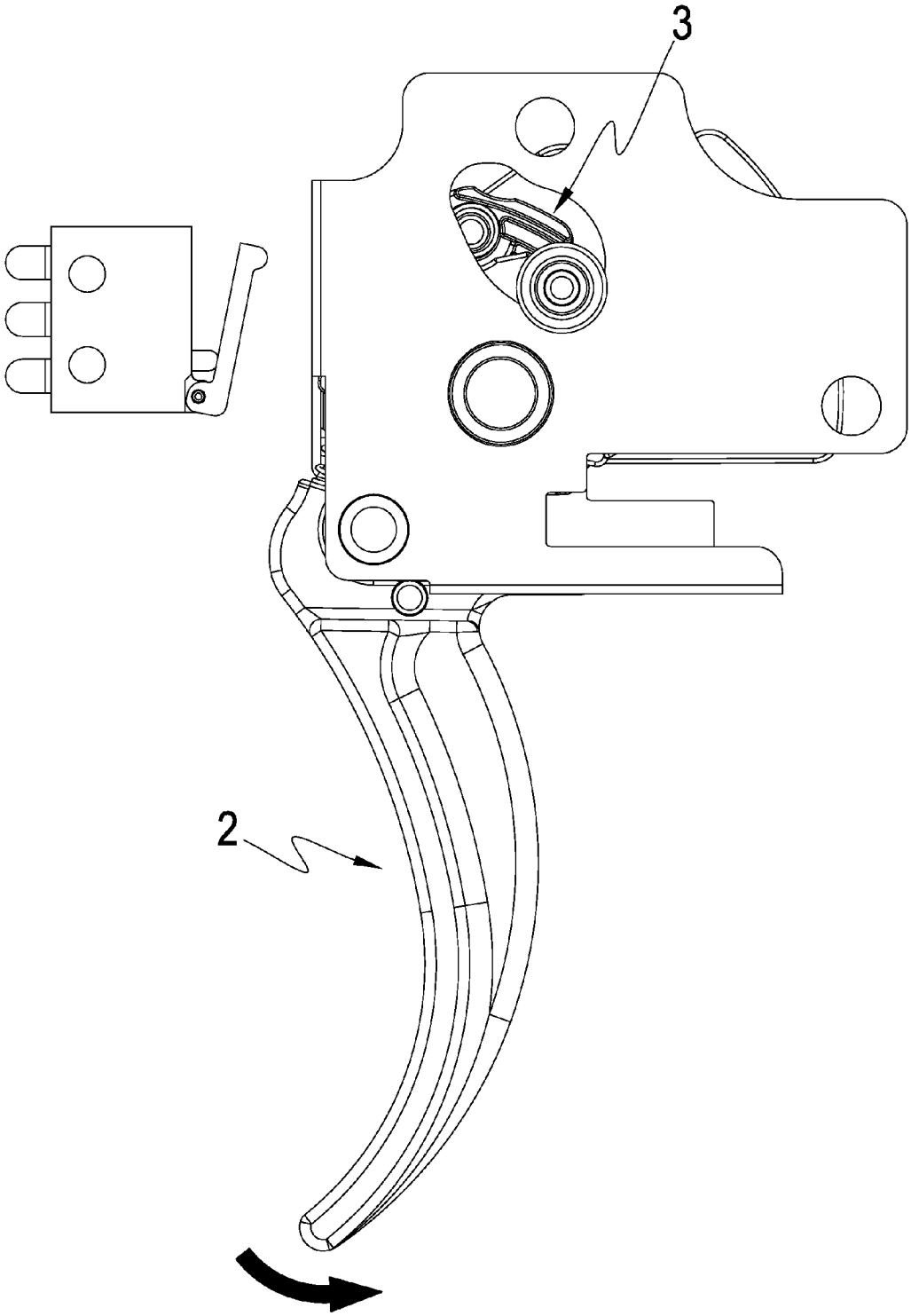
FIG. 5 is a schematic view showing an outside configuration of the present invention in a condition of being ready to actuate.
Figure 6:
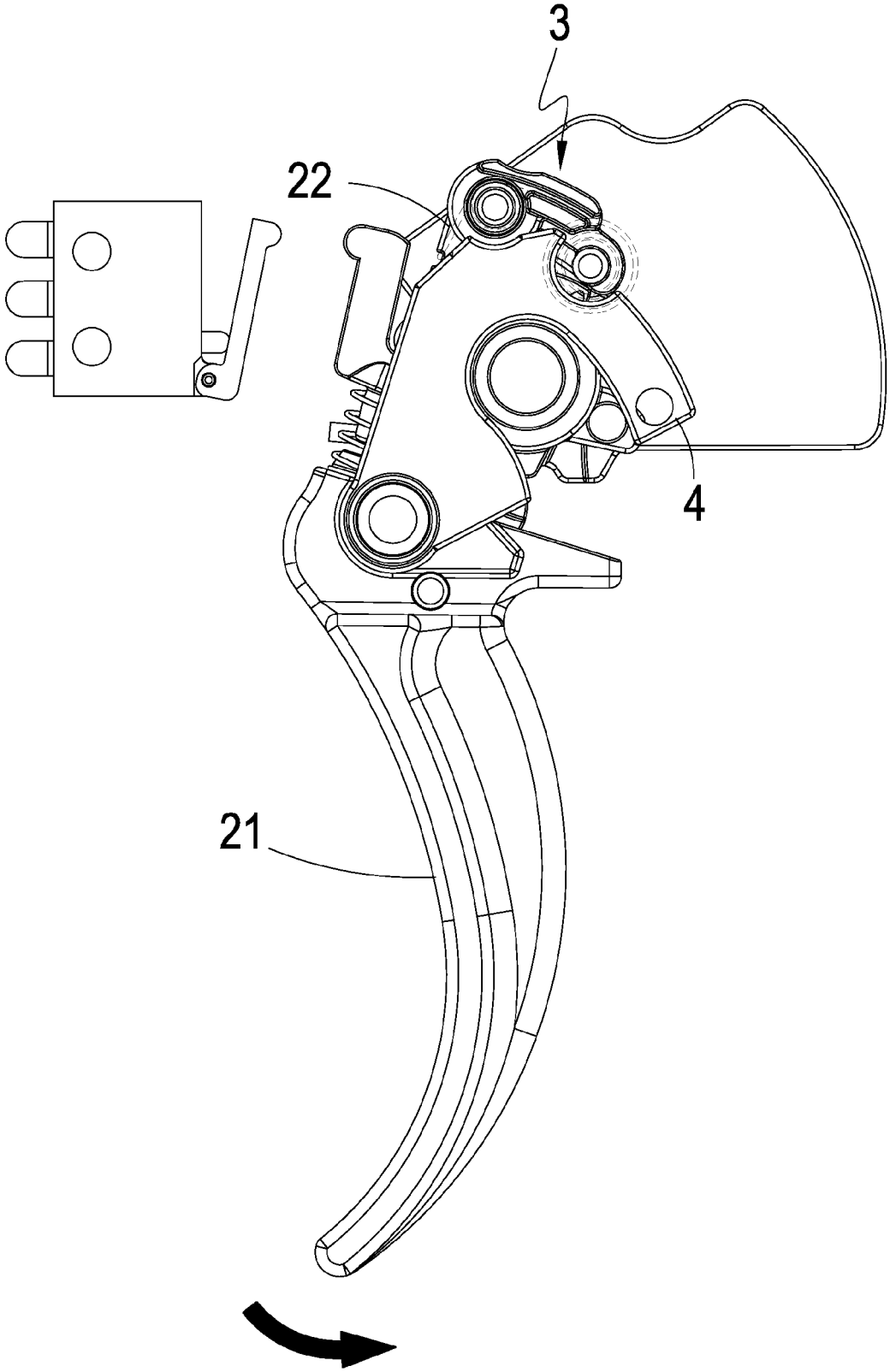
FIG. 6 is a schematic view showing an inside structure of the present invention in a condition of being ready to actuate.
Figure 7:
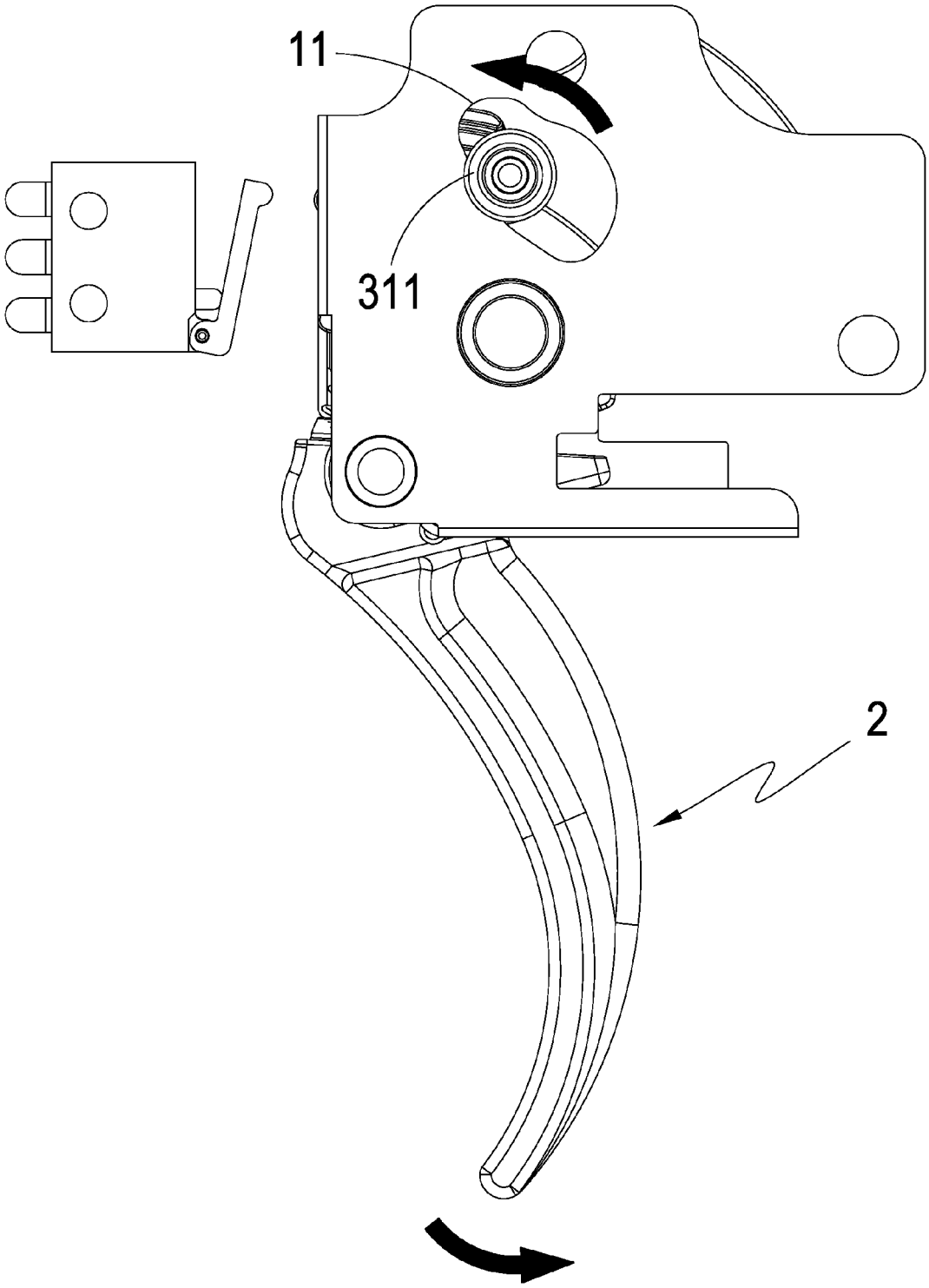
FIG. 7 is a schematic view illustrating of guiding of an actuation operation according to the present invention.
Figure 8:
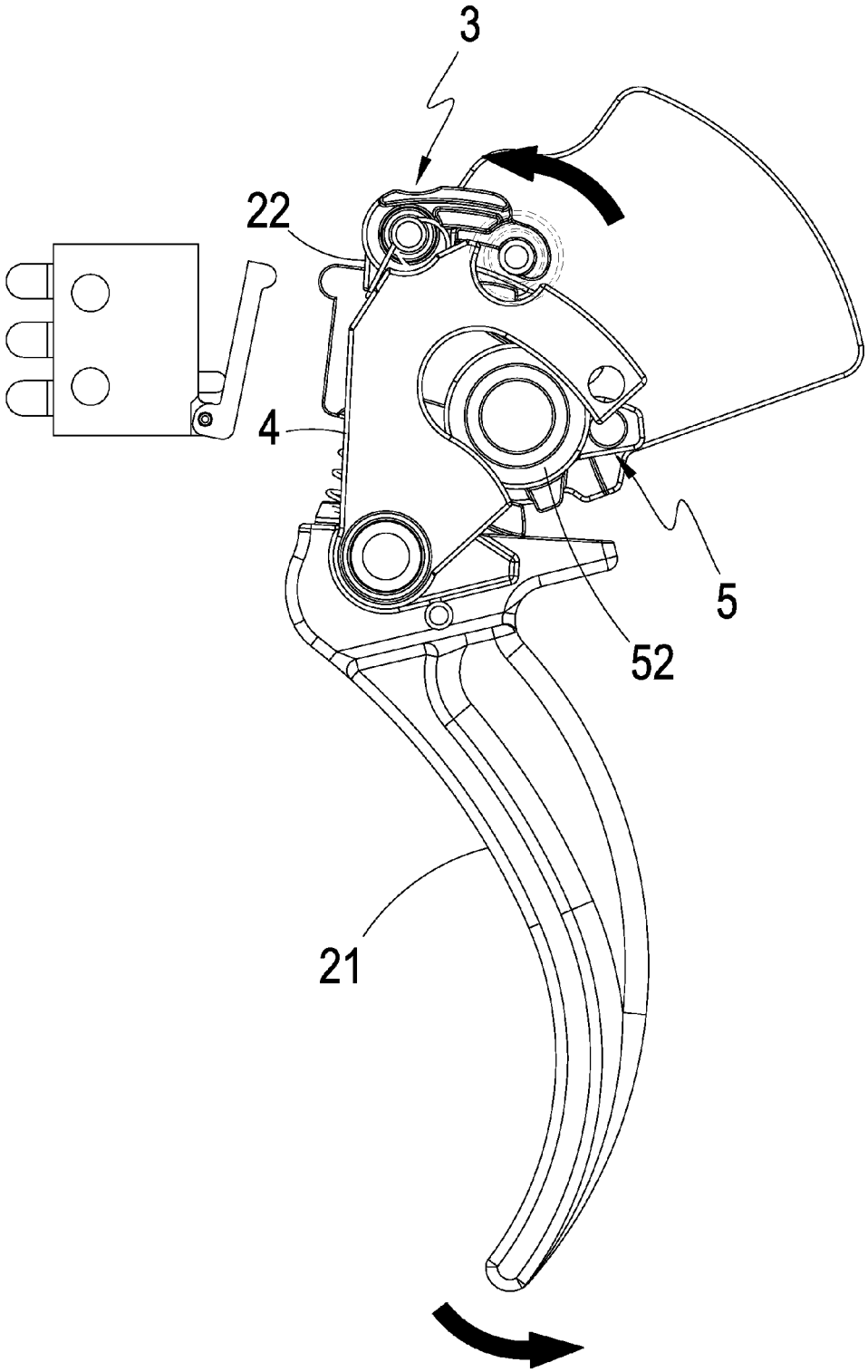
FIG. 8 is a schematic view illustrating operation driving by an actuation operation according to the present invention.
Figure 9:
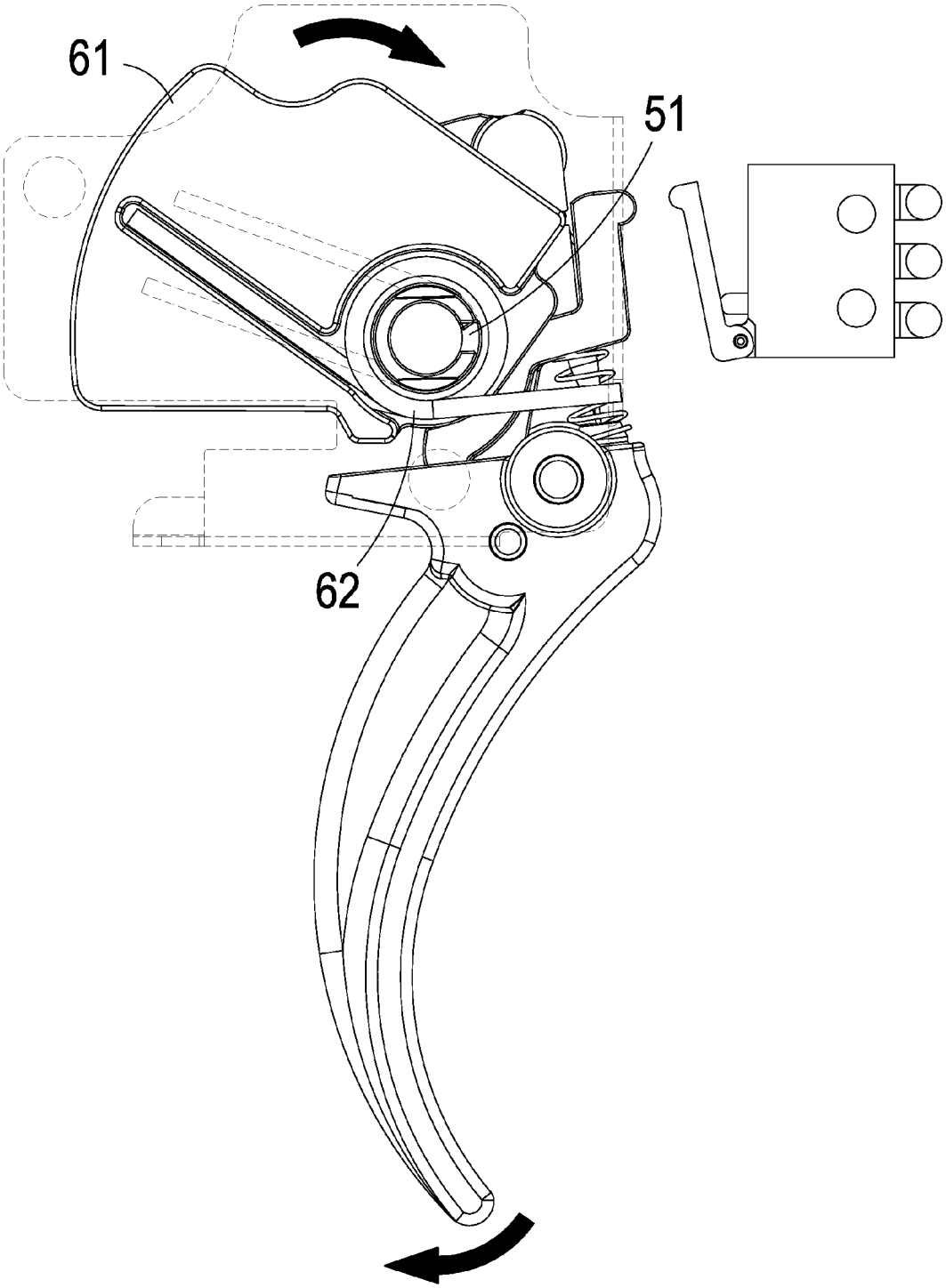
FIG. 9 is a schematic view illustrating energy accumulation caused by an actuation operation according to the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-4B, the present invention comprises a trigger seat 1, a trigger assembly 2, a retainer assembly 3, a toothed rack element 4, a gear shaft assembly 5, at least one striker hammer plate 61, and at least one striker hammer elastic element 62. The trigger seat 1 has one side in which a guide slot 11 is formed and comprises at least one trigger seat elastic section 12 formed on a lower side thereof. The trigger assembly 2 is pivotally connected to one side of the trigger seat 1 and the trigger assembly 2 has an end that forms an actuation section 21 that is arranged to be operated and actuated by an operator and an opposite end that forms a driving section 22 that is pivotally connected to the retainer assembly 3. The pivotal connection between the trigger assembly 2 and the trigger seat 1 is located between the actuation section 21 and the driving section 22. The trigger assembly 2 comprises a constrained section 23 that is formed between the actuation section 21 and the driving section 22 is such a way that the constrained section 23 is in contact with trigger seat elastic section 12 and constrained thereby for the purpose of resuming the position of the trigger assembly 2.

The retainer assembly 3 is arranged in the trigger seat 1. The retainer assembly 3 comprises a retainer element 31 that is operable in combination with the driving section 22 and the toothed rack element 4 and a retainer elastic element 32 for resuming the position of the retainer element 31. The retainer element 31 comprises a guide roller 311 formed at one side thereof to be operable in combination with the guide slot 11 to reduce frictional resistance and thus make movement smooth. The toothed rack element 4 is formed on the trigger seat 1 to be operable in combination with the retainer assembly 3 (the guide roller 311). The gear shaft assembly 5 is mounted on the trigger seat 1 and is operably coupled to the toothed rack element 4 to magnify a movement of the trigger assembly 2. The gear shaft assembly 5 comprises a shaft bar 51 and a toothed wheel element 52 mounted to the shaft bar 51 to be operably coupled to the toothed rack element 4. The striker hammer plate 61 is mounted to the shaft bar 51 and operable in combination therewith. The striker hammer elastic element 62 has an end mounted to the trigger seat 1 and an opposite end coupled to the striker hammer plate 61 so that the striker hammer plate 61 is driven by the trigger assembly 2 to accumulate energy or strike thus generate sounds and vibrations.

Further, the shaft bar 51 comprises at least one arm 511. The actuation section 21 of the trigger assembly 2 comprises at least one switch press bar 7 formed on a lower side thereof. The switch press bar 7 comprises a transmission section 71 formed at one side thereof in the form of a curved surface that corresponds to the arm 511. A switch elastic element 8 is arranged between the switch press bar 7 and the actuation section 21 and has two ends respectively supported by the switch press bar 7 and the actuation section 21 for resuming the position of the switch press bar 7. At least one firing device 9 is arranged at one side of the switch press bar 7 in such a way that the switch press bar 7 is selectively contactable with the firing device 9 to conduct a firing operation.

Referring to FIGS. 1-12, as shown in FIGS. 5-9, it can be clearly seen that the actuation section 21 of the trigger assembly 2, when actuated, rotates by a predetermined angle and causes the driving section 22 to drive the retainer assembly 3 for moving the toothed rack element 4 in such a way that the toothed rack element 4 drives the gear shaft assembly 5 to rotate, making the guide roller 311 to move along the guide slot 11. Under this condition, the gear ratio between the toothed rack element 4 and the toothed wheel element 52 that mate each other helps amplify the angular displacement of the rotation. (For example, with an angular displacement of rotation of the trigger assembly 2 being 0-17 degrees, the angular displacement of the rotation of the gear shaft assembly 5 may reach 0-33 degrees; the illustration given below is based on the assumption that the angular displacement of the trigger assembly 2 that is necessary for conducting a firing operation is 17 degrees.) The shaft bar 51 causes the striker hammer plate 61 to rotate so as to twist the striker hammer elastic element 62 to accumulate energy therein.

Figure 10:
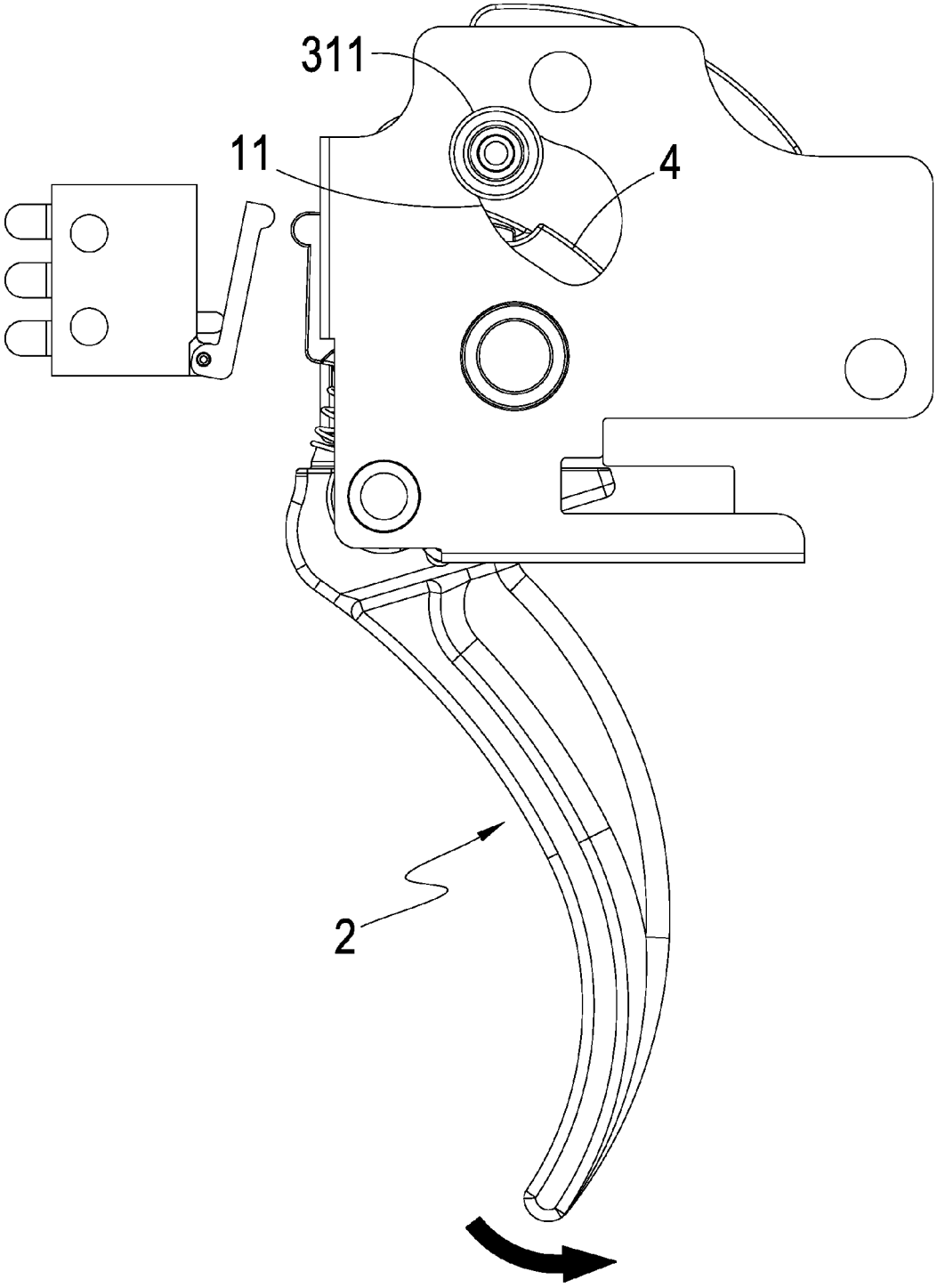
FIG. 10 is a schematic view illustrating guiding of release according to the present invention.
Figure 11:
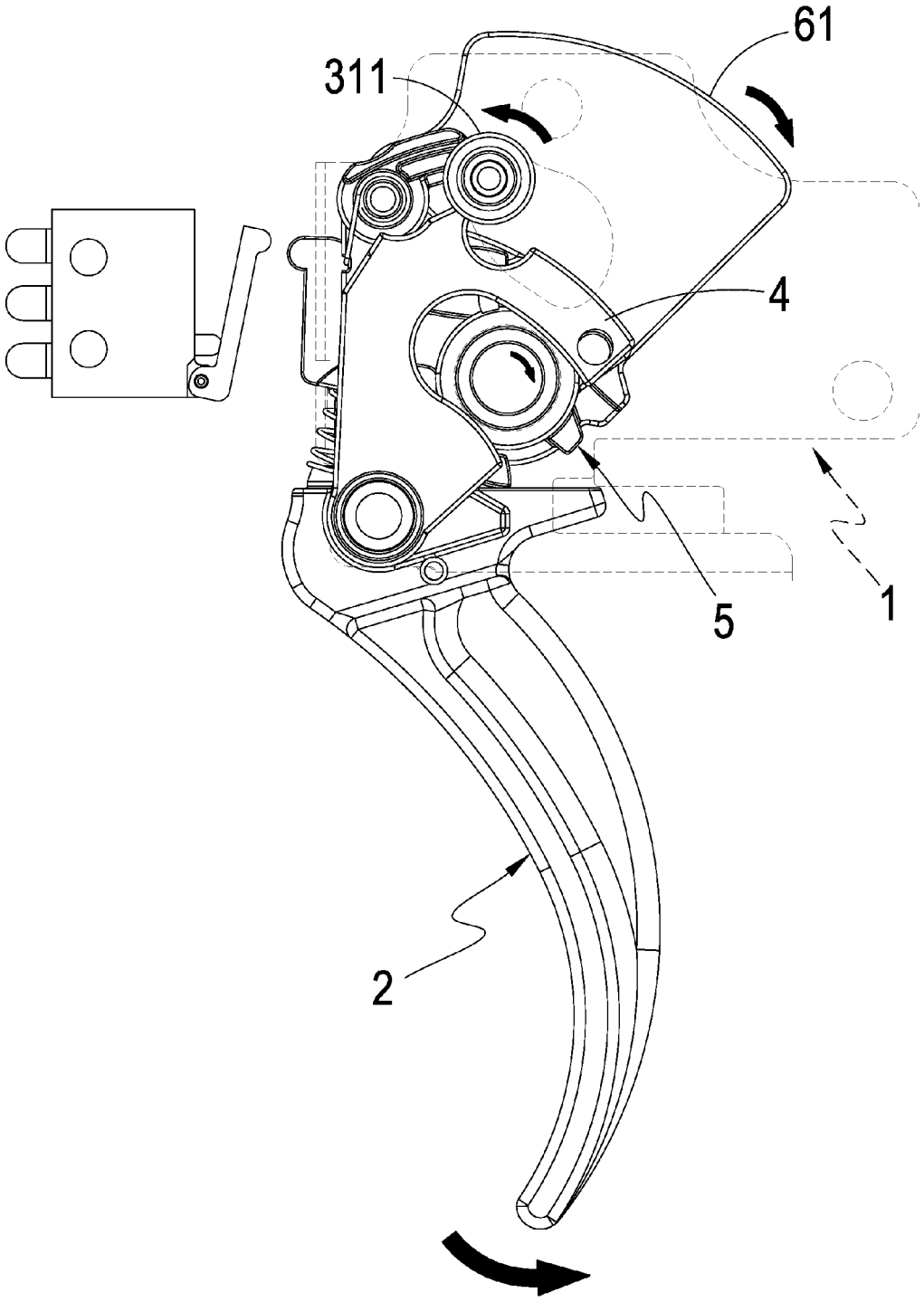
FIG. 11 is a schematic view illustrating a strike caused by being driven according to the present invention.

As shown in FIGS. 10 and 11, when the trigger assembly 2 angularly displaces by an angle exceeding 16 degrees, the guide roller 311 is guided by the guide slot 11 to move and is thus raised upwards. The guide roller 311 makes a rolling movement along the guide slot 11 so as to reduce the frictional resistance and make the movement smooth. The upward raising of the guide roller 311 allows the toothed rack element 4 to be released therefrom and the striker hammer elastic element 62 (not visible in these drawings) is thus allowed to release the energy accumulated therein so as to force the gear shaft assembly 5 and the striker hammer plate 61 to rotate in an opposite direction, whereby the striker hammer plate 61 is caused to strike thus generate sounds and vibrations, achieving a purpose of simulation of a true device. Further, since the striker hammer plate 61 takes a rotary motion, rather than a linear straight stroke, to make the strike to generate sounds and vibrations so that the size can be reduced, allowing easy applications to various models of electric guns.

Figure 12:
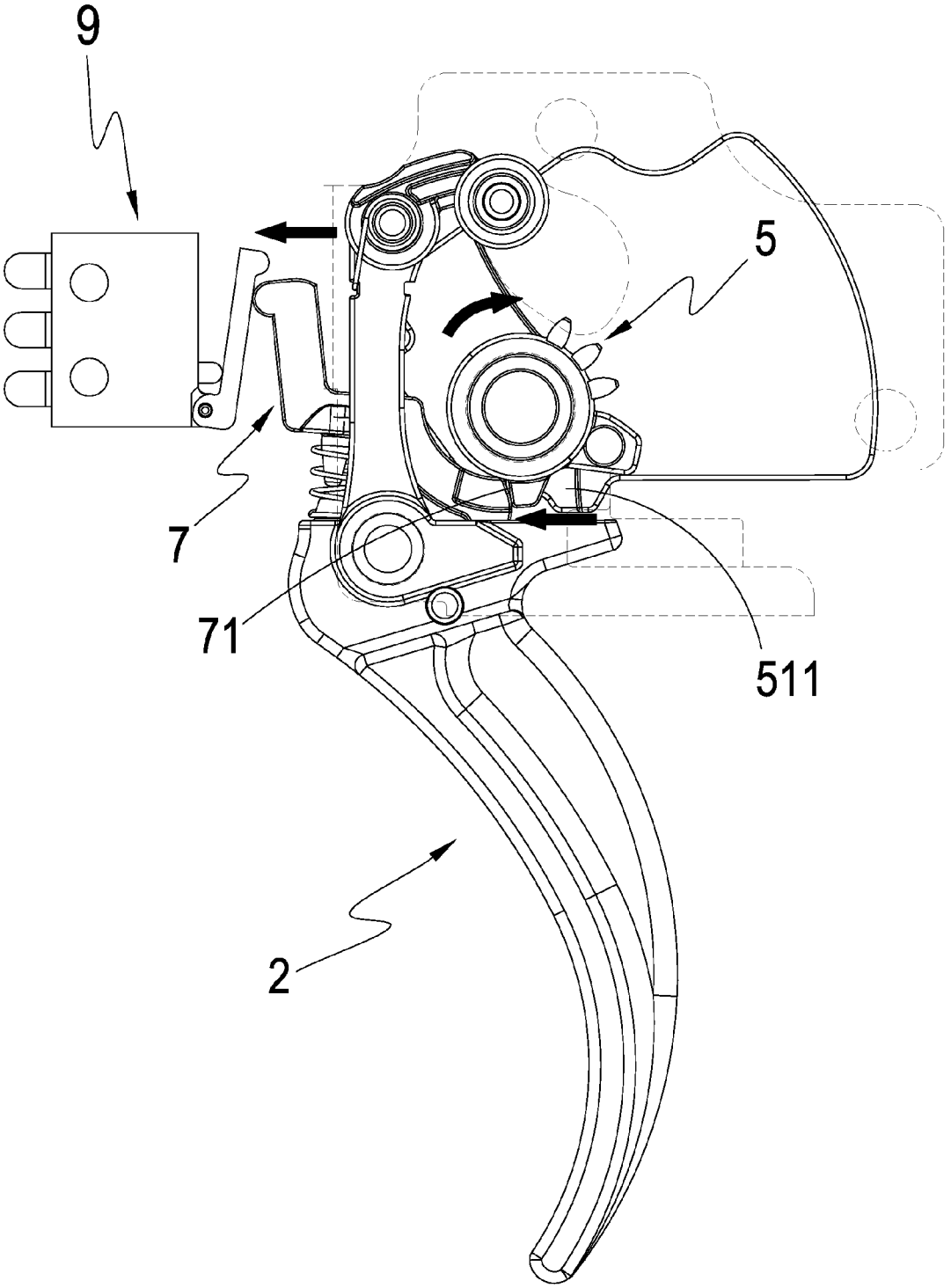
FIG. 12 is a schematic view illustrating firing caused by being driven according to the present invention.

As shown in FIG. 12, when the trigger assembly 2 rotates an angle exceeding 16 degrees to cause the gear shaft assembly 5 to rotate in the opposite direction, the arm 511 gets engagement with the transmission section 71, causing the switch press bar 7 to make a movement so that the switch press bar 7 is rotated to contact the firing device 9 for initiating a firing operation.

Further, when the trigger assembly 2 is rotating but still not exceeding 16 degrees, the guide roller 311 still kept the toothed rack element 4 retained so that no sound or vibration is generated and no firing is initiated. This allows an operator to clearly perceive an idle stroke after the actuation of the trigger assembly 2 but before the firing operation is initiated.

Further, after the firing, the striker hammer elastic element 62 returns the striker hammer plate 61 and the gear shaft assembly 5 back to their original positions and the switch elastic element 8 causes the switch press bar 7 to move back to the original position. Further, when the operator releases the actuation section 21, the trigger seat elastic section 12 forces the trigger assembly 2 and the retainer assembly 3 back to the original positions and the retainer element 31 is driven by the spring force of the retainer elastic element 32 under the guidance achieved with the engagement between the guide roller 311 and the guide slot 11 to get back to the original position, allowing the guide roller 311 and the toothed rack element 4 to get engagement with each other. As such, a cycle of operation is completed and the device is ready for next actuation.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A trigger emulation mechanism of an electric gun, comprising:

a trigger seat, wherein the trigger seat has a side in which a guide slot is formed;

a trigger assembly, wherein the trigger assembly is pivotally connected to one side of the trigger seat;

a retainer assembly, wherein the retainer assembly is mounted in the trigger seat and is operably coupled to the trigger assembly, the retainer assembly comprising a guide roller formed at one side thereof to be operable in combination with the guide slot;

a toothed rack element, wherein the toothed rack element is formed on the trigger seat to be operable in combination with the retainer assembly;

a gear shaft assembly, wherein the gear shaft assembly is mounted on the trigger seat and is operably coupled to the toothed rack element to amplify a movement of the trigger assembly;

at least one striker hammer plate, wherein the striker hammer plate is mounted to the gear shaft assembly and operable in combination therewith; and at least one striker hammer elastic element, wherein the striker hammer elastic element has an end mounted to the trigger seat and an opposite end coupled to the striker hammer plate so that the striker hammer plate is driven by the trigger assembly to accumulate energy or strike thus generate sound and vibration.

2. The trigger emulation mechanism of the electric gun according to claim 1, wherein the trigger assembly has an end that forms an actuation section adapted to be operated and actuated by an operator and an opposite end that forms a driving section that is pivotally connected to the retainer assembly and the pivotal connection between the trigger assembly and the trigger seat is located between the actuation section and the driving section.

3. The trigger emulation mechanism of the electric gun according to claim 2, wherein the trigger seat comprises at least one trigger seat elastic section formed on a lower side thereof and the trigger assembly comprises a constrained section that is formed between the actuation section and the driving section in such a way that the trigger seat elastic section applies a force to the constrained section for position returning of the trigger assembly.

4. The trigger emulation mechanism of the electric gun according to claim 2, wherein the actuation section comprises at least one switch press bar formed on a lower side thereof and the gear shaft assembly comprises at least one arm, the arm being operable in combination with the switch press bar.

5. The trigger emulation mechanism of the electric gun according to claim 4, wherein the gear shaft assembly comprises shaft bar to which the arm is mounted and receives the striker hammer plate to mount thereto and a toothed wheel element (52) mounted to the shaft bar and operably coupled to the toothed rack element.

6. The trigger emulation mechanism of the electric gun according to claim 4, wherein the switch press bar comprises a transmission section formed at one side thereof in the form of a curved surface that corresponds to the arm to make a firing operation smooth.

7. The trigger emulation mechanism of the electric gun according to claim 4, wherein at least one firing device is arranged at one side of the switch press bar and the switch press bar is selectively contactable with the firing device.

8. The trigger emulation mechanism of the electric gun according to claim 4, wherein a switch elastic element is arranged between the switch press bar and the actuation section and has two ends respectively supported by the switch press bar and the actuation section for position returning of the switch press bar.

9. The trigger emulation mechanism of the electric gun according to claim 1, wherein the retainer assembly comprises a retainer element that comprises the guide roller and a retainer elastic element for positioning returning of the retainer element, the retainer element being operable in combination with the toothed rack element and the trigger assembly.

* * * * *